United States Patent [19]

Lang et al.

[11] Patent Number: 4,679,574

[45] Date of Patent: Jul. 14, 1987

[54] CIGARETTE

[75] Inventors: Paul W. Lang; Franklin C. Gribshaw, both of Orange, Calif.

[73] Assignee: C. Allen Jensen, Pasadena, Calif.

[21] Appl. No.: 832,168

[22] Filed: Feb. 20, 1986

[51] Int. Cl.[4] ..... A24D 1/02; A24D 1/12

[52] U.S. Cl. ..... 131/365; 131/284; 131/336; 131/349; 131/362

[58] Field of Search ..... 131/349, 94, 336, 365, 131/362, 284

[56] References Cited

U.S. PATENT DOCUMENTS 4,480,650 11/1984 Weinert ..... 131/349

*Primary Examiner*—V. Millin

*Attorney, Agent, or Firm*—Kelly, Bauersfeld & Lowry

[57] ABSTRACT

A cigarette made of cut tobacco rolled in a paper having a refractory layer with a predetermined pattern bonded to or imprinted upon the interior surface of the paper. The pattern is formed outside of rows and columns of what eventually become elongated slots when the paper burns away. The slots are arranged in lengthwise rows and also are arranged in columns. Each row has a slot midpoint which lies midway between slots in each adjacent row.

12 Claims, 3 Drawing Figures

CIGARETTE

BACKGROUND OF THE INVENTION

This invention relates to smoking materials, and more particularly to a cigarette having an ash which will not become detached except when subjected to large forces tending to dislodge the same.

PRIOR ART STATEMENT

It is known in the prior art to print identifying indicia on the exterior surface of cigarette papers. However, the same has not increased the structural strength of a conventional cigarette.

In the prior art, it has been noticeable that the wind in an automobile, with the windows open, and the wind at the beach, or elsewhere, will blow the ash off of the end of a cigarette. The ash may then blow into a person's eye and cause pain or discomfort. Further, the ash may still be lit and/or it may be hot and cause even further discomfort. A hot ash may also be dropped onto clothing and the same ignited. A hole may thus be created in the clothing by burning. At least, the ash on the clothing becomes unsightly.

SUMMARY OF THE INVENTION

In accordance with the cigarette of the present invention, the above-described and other disadvantages of the prior art are overcome by providing a measure of cut tobacco and a cigarette paper. The tobacco is rolled in the cigarette paper to form a cigarette. The cigarette paper has an interior surface in direct contact with the tobacco. A thin layer of refractory material is fixed relative to said interior surface inside thereof. The thin layer of refractory material is made perforate to allow the cigarette to draw air therethrough and through the paper.

One outstanding feature of the invention resides in the use of a refractory material strong enough to add to the shear strength of the burnt ash, and thin and weak enough to be broken manually without demolishing the unburnt portion of the cigarette.

In accordance with the foregoing, the wind will not blow the ash of the cigarette of the present invention into the eyes or onto clothing as in the prior art. Eye discomfort and messy or burned clothing are thereby avoided.

BRIEF DESCRIPTION OF THE DRAWINGS

In the drawings, which are to be regarded as merely illustrative.

DESCRIPTION OF THE PREFERRED EMBODIMENT

Figure 1:
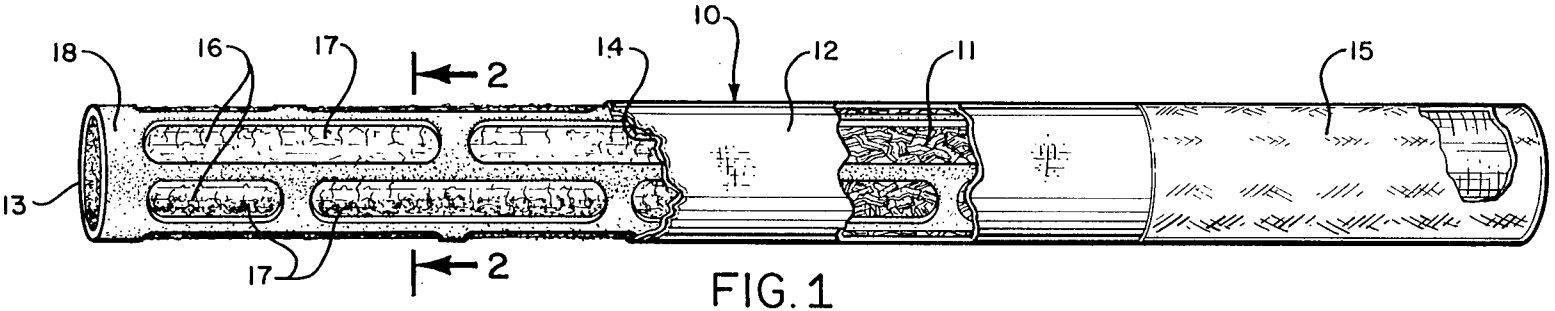
FIG. 1 is a side elevational view, partly in section, of a constructed cigarette in accordance with the present invention.
Figure 2:
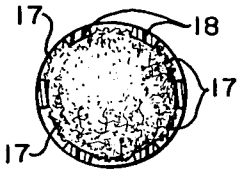
FIG. 2 is a transverse sectional view of the cigarette of FIG. 1 taken on the line 2—2 shown therein.

In the drawing in FIG. 1, a cigarette 10 is shown constructed in accordance with the present invention. Cigarette 10 includes cut tobacco 11 covered with a cigarette paper 12 that has burned from one end 13 of the cigarette 10 to a point 14 along the length thereof.

A conventional filter tip is provided at 15.

Burnt ash 16 is visible through apertures 17 in a thin film or layer 18 of a refractory like material. This material may be any fire resistant epoxy manufactured by the Minnesota Mining and Manufacturing Company, if desired.

Figure 3:
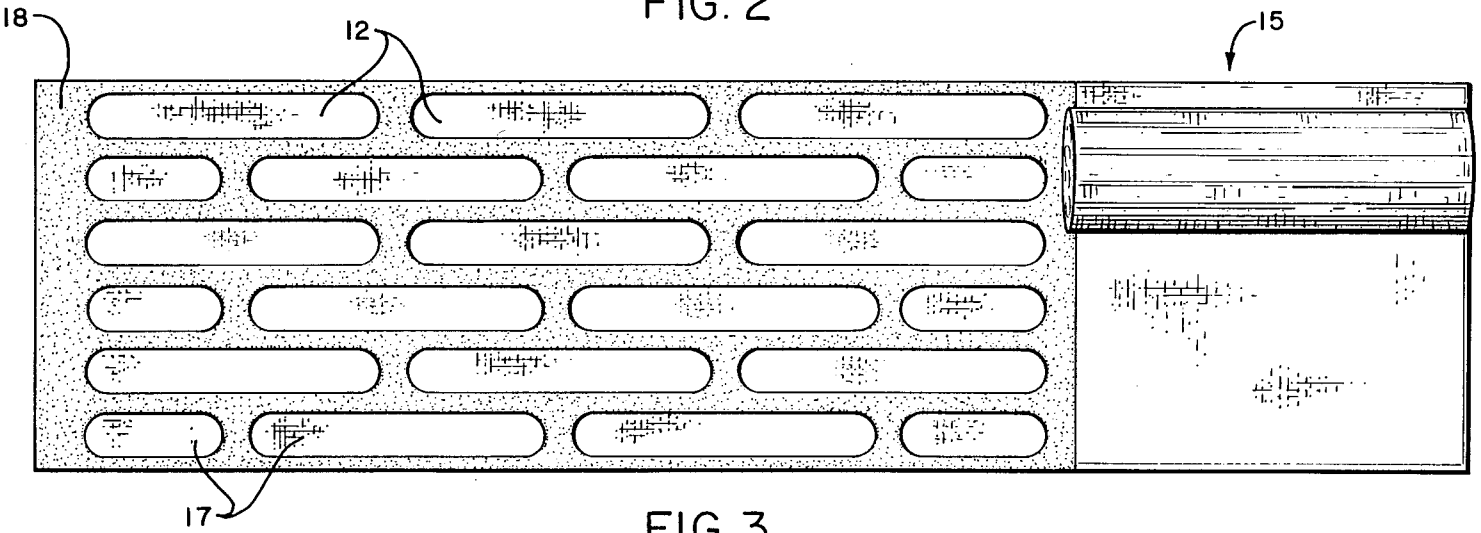
FIG. 3 is a bottom plan view of a cigarette paper constructed in accordance with the invention.

As shown in FIG. 3, the unburned cigarette paper 12 covers refractory layer 18 on the reverse side thereof. Paper 12 thus only shows through holes or elongated slots which form the apertures 17.

Note that the thin layer 18 of the refractory material is bonded to the interior surface of paper 12.

Preferably, the thin layer 18 is printed on the interior surface of paper 12.

Preferably, the thin layer 18 is printed in a pattern, the pattern being formed by the spaced slots 17.

Preferably, the holes 17 are elongated slots.

Note that the slots 17 are uniformly spaced in rows and columns.

Note that slots 17 extend lengthwise in rows each row having slots with midpoints at positions midway between slots 17 of rows adjacent thereto.

In accordance with the cigarette 10 of the present invention, the wind will not blow the ash 16 of the cigarette 10 into the eyes or onto clothing of a person as in the prior art. Eye discomfort and burned clothing are thereby avoided.

The description and drawings hereof are exemplary only. Thus, the cigarette of the present invention is not to be limited to this precise disclosure, the same being defined only in the appended claims.

If desired, thin layer 18 may be a silk screened, fire-resistant epoxy adhesive layer of the general type marketed by the 3M Company, St. Paul, Minn. Alternately, the layer 18 can be applied by lithography or other suitable techniques.

What is claimed is:

1. A smoking device comprising:
a measure of cut tobacco;
a cigarette paper;
said measure of cut tobacco being rolled in said cigarette paper to form a cigarette;
said cigarette paper having an interior surface in direct contact with said measure of cut tobacco; and
a thin layer of refractory material bonded to said paper interior surface;
wherein said thin layer is applied in a pattern, and said pattern is formed by spaced holes in said thin layer.

2. The invention as defined in claim 1, wherein:
said holes are elongated slots.

3. The invention as defined in claim 2, wherein:
said refractory material is strong enough to add to the shear strength of the burnt ash, and thin and weak enough to be broken manually without demolishing the unburnt portion of the cigarette.

4. The invention as defined in claim 2, wherein:
said slots are uniformly spaced in rows and columns.

5. The invention as defined in claim 4, wherein:
said refractory material is strong enough to add to the shear strength of the burnt ash, and thin and weak enough to be broken manually without demolishing the unburnt portion of the cigarette.

6. The invention as defined in claim 4, wherein:
said slots extend lengthwise in said rows,
each row having slots with midpoints at positions midway between slots of rows adjacent thereto.

7. The invention as defined in claim 6, wherein:
said refractory material is strong enough to add to the shear strength of the burnt ash, and thin and weak enough to be broken manually without demolishing the unburnt portion of the cigarette.

8. The invention as defined in claim 1, wherein:

said holes are uniformly spaced in columns and rows.

9. The invention as defined in claim 8, wherein:

said refractory material is strong enough to add to the shear strength of the burnt ash, and thin and weak enough to be broken manually without demolishing the unburnt portion of the cigarette.

10. The invention as defined in claim 8, wherein:

said holes extend lengthwise in said rows, each row having holes with centers at positions midway between holes of rows adjacent thereto.

11. The invention as defined in claim 10, wherein:

said refractory material is strong enough to add to the shear strength of the burnt ash, and thin and weak enough to be broken manually without demolishing the unburnt portion of the cigarette.

12. The invention as defined in claim 1, wherein:

said refractory material is strong enough to add to the shear strength of the burnt ash, and thin and weak enough to be broken manually without demolishing the unburnt portion of the cigarette.

* * * * *